United States Patent [19]

Potter

[11] 4,273,174

[45] Jun. 16, 1981

[54] HANDBAG

[76] Inventor: Mary S. Potter, 1020 Glann Rd., Toledo, Ohio 43607

[21] Appl. No.: 74,961

[22] Filed: Sep. 13, 1979

[51] Int. Cl.[3] ..... B65D 33/06

[52] U.S. Cl. ..... 150/3; 150/12; 150/28 R

[58] Field of Search ..... 150/1.7, 3, 12, 33; 229/54 R; 224/267

[56] References Cited

U.S. PATENT DOCUMENTS

| | | | |
|---|---|---|---|
| 1,236,285 | 8/1917 | Gallie | 150/3 |
| 2,532,778 | 12/1950 | Mintzes | 150/1.7 |
| 3,550,663 | 12/1970 | Johnston | 150/33 X |
| 4,127,155 | 11/1978 | Hydorn | 150/1.7 |
| 4,136,723 | 1/1979 | Skaadel | 229/57 X |
| 4,180,111 | 12/1979 | Davis | 150/1.7 |

FOREIGN PATENT DOCUMENTS

| | | | |
|---|---|---|---|
| 901532 | 5/1972 | Canada | 229/54 R |

*Primary Examiner*—Donald F. Norton

*Attorney, Agent, or Firm*—Wilson, Fraser, Barker & Clemens

[57] ABSTRACT

A container is formed of a composite piece of material having at least two different facing fabrics or a flexible sheet material having facings of complementary colors and/or textures. The material is folded at midlength to form two equal sidewalls joined at the bottom and the sides to form an article containing portion. Two strap-loops extend upwardly from the article containing portion and include inwardly extending cutout areas along the outer edges and outwardly extending cutout areas along the inner edges. The strap-loops may be manipulated in various manners to provide for security to the contents.

17 Claims, 6 Drawing Figures

HANDBAG

BACKGROUND OF THE INVENTION

The present invention relates to a flexible container, adapted for use as a handbag, having novel structural, esthetic and functional characteristics.

Today, there are numerous handbags available, comprising different materials, natural, synthetic and combinations thereof, including different colors and different textures. Many of these handbags available have various strap configurations and/or various closures to secure the contents therein. A limiting feature of the handbags available on the market appears to be with regard to the number of color combinations and/or texture combinations and the manner in which the straps or loops can be employed by the user of the handbag.

The present invention is an improvement upon available handbags, esthetically and functionally. The present handbag or container is preferably made from a single composite material, comprising at least two different facing materials, with regard to color, texture and/or weave. The composite material is made by taking two different facing fabrics and placing one upon the other and cutting out an essentially rectangular configuration, cutting out areas to form a central opening and lateral opposed side openings, folding the composite material on its transverse midline to form two equal sidewalls and joining the sidewalls at the bottom and side edges except for the cutout areas. The cutout areas are the same shape and dimension whereby when the sidewalls are joined, strap-loops are formed that are esthetically appealing and functionally useable.

One advantage of the present invention comprises allowing the user to accesorize by choosing specific color and/or texture combinations, by folding the straps and/or drawing one strap through another and turning the fabric to obtain more than one color and/or texture combination. Another advantage of the present invention is that the cutout areas which form geometric designs eliminate bulk, thereby enabling the user to make multiple folds without the esthetic appearance disappearing. Still another advantage of the present invention lies in the fact that the container is completely reversible whereby the inside facing fabric can be reversed to become the outside facing fabric and hence more color combinations can appear.

The flexible container or handbag is well suited for its user to hold and carry personal items, especially those items having great personal value. And, its user has a great degree of flexibility regarding color and/or texture coordination of the handbag with the mood and/or clothing.

SUMMARY OF THE INVENTION

An object of the present invention is therefore to provide a handbag having improved structural, esthetic and functional characteristics.

Another object of the present invention is to provide an improved handbag which allows its user fabric and color flexibility and content security while transporting personal items.

The structural and functional features of the present invention enable the handbag to have greater user flexibility and security by deleting some bulk in the cutout areas that form the strap-loops. The esthetic features of the present invention are in combination with the above structural features, by providing a choice of color, texture and weave in the selected flexible sheet materials employed.

According to the present invention, a flexible container is made from a composite fabric comprising at least two different facing fabrics or a flexible sheet material having facings of complementary colors and/or textures. The composite fabric or flexible sheet material is cut to shape and subsequently cutout areas are made to provide the openings when the composite fabric or material is folded along its transverse midline. The folded composite fabric or flexible sheet material thus forms two substantially equal sidewalls which are joined at the bottom and opposed sides except for the areas that define the cutout areas, thus forming a lower portion or container, and an upper portion, having strap-loops for grasping and for manipulation. One feature of the invention is to form a single piece of composite material from at least two different facing materials. This may be done in a number of ways, one of which is to place one fabric over another fabric and then cut the double-layered fabric to shape and fold the same on its transverse midline to obtain two substantially equal sidewalls.

Another way to obtain the same effect is by taking two different fabrics, laying them side by side, and joining them and doing likewise with another set of similar fabrics and laying one on top of the other so that instead of a smooth fold at the transverse midline, the two separate composite fabrics are joined to form a transverse midline.

Another feature of the invention is to form esthetic strap-loops, of specific geometric design, which strap-loops are not only functional in grasping and holding the handbag, but are also functional in loose-closing and knot-closing of the handbag. No closure means is provided with the handbag, such as a zipper or buttons, so the strap functions not only as a handle but also a closure means. This is not to say that some type of closure means such as velcro strips or buttons or zippers may not be employed, but to obtain the highest degree of movement by ingress and egress these specific closure means are preferably omitted.

The flexible container according to the invention is preferably made from a single piece of composite material, for instance where the composite material comprises two differently colored and/or textured facing fabrics and one facing fabric is placed on top of the other. The composite material can then be cut to size and the center opening and opposed side openings made prior to or after folding the composite material along its transverse midline. When the geometric shape and dimension of the cutout areas are substantially the same, upon folding of the composite material as described, strap-loops are formed. The fabrics are joined in a suitable fashion such as by finished sewing to secure the edges for a finished look and then the sides of the sidewall and the bottom portion of the sidewall are formed and finished in a suitable manner. One special feature of this method is that the strap-loops that are provided are sufficiently wide at the top where the user can grab the strap or insert an arm through the straps, and the strap-loops narrow as they converge upon the actual container portion of the handbag thus reducing some bulk that otherwise would be present. This lack of bulk in the strap-loop area allows the user additional flexibility and functionality when folding the loops one upon the other and/or inserting one through the other to make a loose closure or a knot-like closure. Prior to the fabric being folded, if the cuts are made at that time, the dimension of the cuts are preferably substantially one-half the length from the midline to each base of the composite fabric. When the cutout areas area substantially more or less than one-half the length from the midline to the base, some functional and esthetic qualities are lost.

A characteristic feature of the flexible container according to the invention is that the two different facing fabrics or materials allow the user substantial latitude in choosing his or her mood or color combination for the day. For example, when the loops are folded one upon the other, the interior facing may be twisted or folded so as to expose itself and thus become an exterior facing which is in contrast to the facing on the exterior body of the container. Additionally, an external pocket may be put on either or both sides of the external facing of the container and, if desired, internal pockets may be so provided.

BRIEF DESCRIPTION OF THE DRAWINGS

The design of the flexible container and method for producing it according to the present invention will be further explained with reference to the accompanying drawings, wherein.

DETAILED DESCRIPTION OF THE INVENTION

Figure 6:
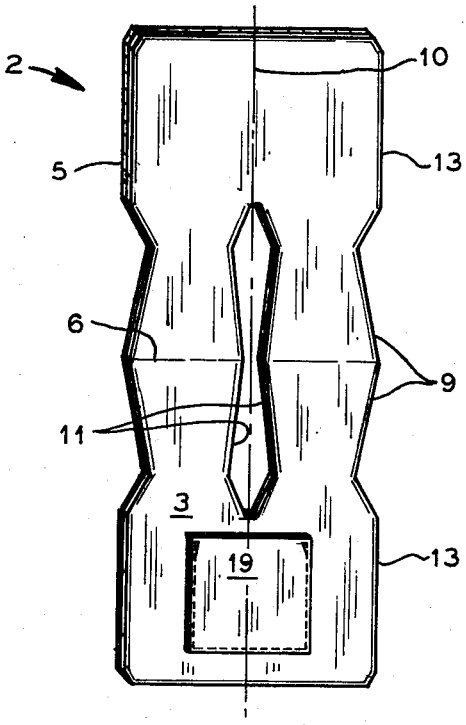
FIG. 6 is a perspective view of composite material which has been cut to shape and has cutout areas, prior to folding at the transverse midline thereof.

In FIG. 6 there is shown an unfolded single piece of composite material 2, from which a container is made according to a preferred method of the invention. The composite material 2 is illustrated as being previously cut to size and has cutout areas. The composite material, which comprises two facing materials, has been joined together such as by sewing. One of the facing fabrics is generally indicated by reference numeral 3 and the edge of another facing fabric is generally indicated by reference numeral 5. The composite material includes lateral inwardly extending cutout areas 9 and outwardly extending cutout areas 11 formed along the central longitudinal axis 10 of the container or of the composite material. The composite material 2 is folded at its transverse midline 6 to initiate the forming of the container structure. Upon folding, two substantially equal sidewalls 13 are formed and are joined at the bottom edge and opposed edges except for the cutout areas to thus form the container having two strap-loops.

Alternatively, the container can be made from two separate pieces of composite material each having a length equal to half the composite piece 2 shown in FIG. 6. Such two pieces may be joined together along the midline 6, as shown in FIG. 6. Thereafter, the procedure is substantially the same to form the container structure.

Figure 1:
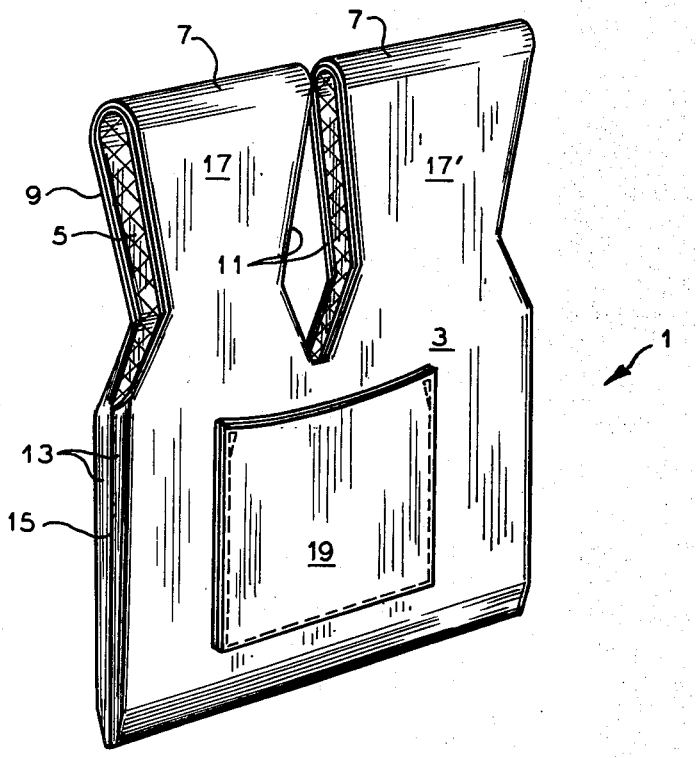
FIG. 1 is a perspective view of a handbag embodying the features of the invention.
Figure 2:
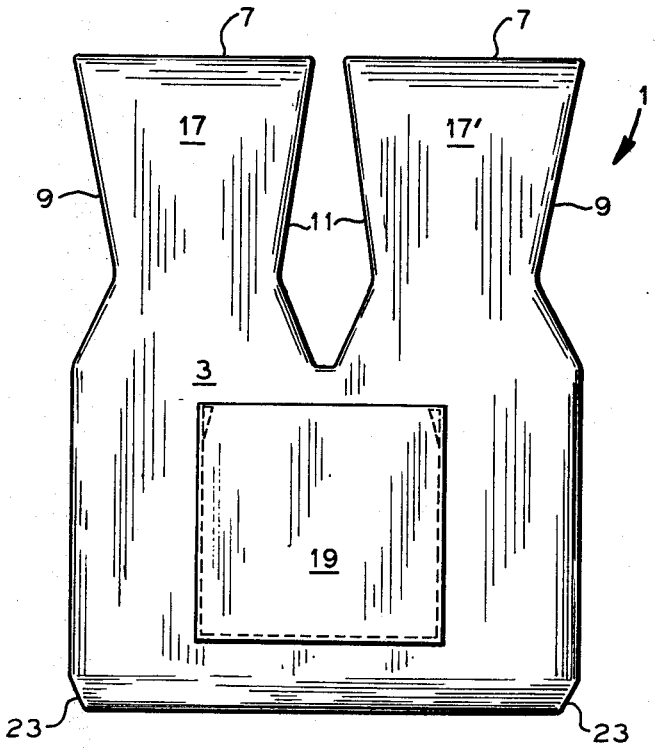
FIG. 2 is a front view of the handbag illustrated in FIG. 1.
Figure 3:
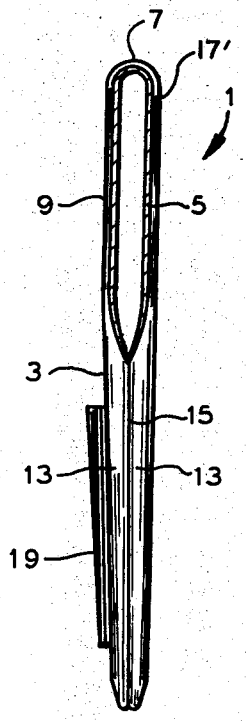
FIG. 3 is a side elevational view thereof.

With reference to FIGS. 1, 2 and 3 the flexible container 1, includes an external facing fabric 3 and an internal facing fabric 5, thus providing a color or texture contrast, as will become more readily apparent hereinafter. The two sidewalls are formed by folding the composite fabric along the transverse medial line to produce a fold 7 and the edges of the sidewalls 15 are shown joined. The laterally inwardly extending cutout areas 9 and the outwardly extending cutout areas 11 along the central longitudinal axis 10 of the container cooperate to produce spaced apart strap-loops 17 and 17'. The strap-loops 17 and 17' are shown to be of symmetrical geometric design and contain less bulk in their lower portion than in their upper portion.

The flexible container 1, may include an external pocket 19 having the same external facing fabric 3 as the container itself. The fold 7 is shown at the transverse midline of the composite fabric 2, and inwardly extending cutout areas 9 and outwardly extending cutout areas 11 along the central longitudinal axis 10 of the container provide the openings for user access. The bottom corners of the container are typically formed in as at 23 to blend in with the geometric cutout areas, if desired.

The edges of the sidewalls 13 are typically joined in a common seam as at 15.

Figure 4:
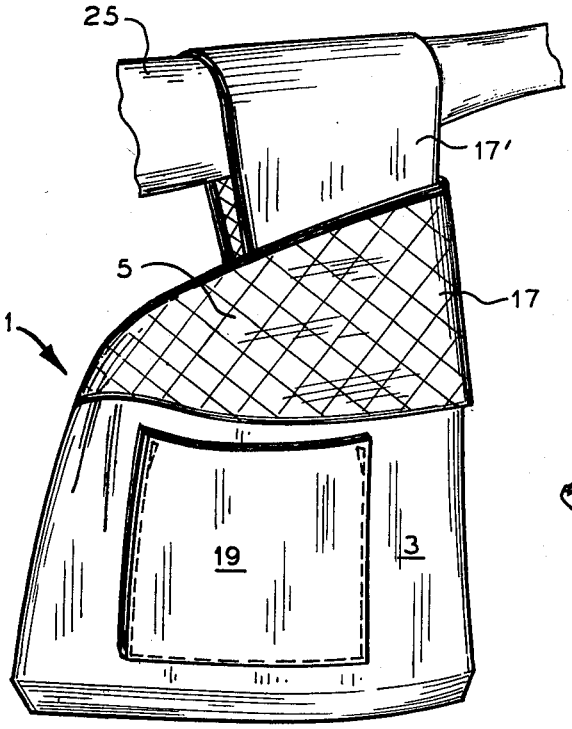
FIG. 4 is a front view thereof, showing one strap folded upon the other strap and exposing its interior surface.

FIG. 4 shows the container or handbag 1 in a position of use with a user's arm 25 slipped through one of the loops 17'. The adjacent loop 17 is shown to have been slipped over the other loop 17' and then twisted to expose the interior facing fabric 5, thus providing a contrast with the exterior facing fabric 3 of the handbag 1. This configuration shows the esthetic features of the present invention as well as a loose closure of the handbag via the one strap. Also shown is a pocket 19 having the same facing fabric as the exterior facing fabric 3, although another facing fabric could be used if esthetically desired.

Figure 5:
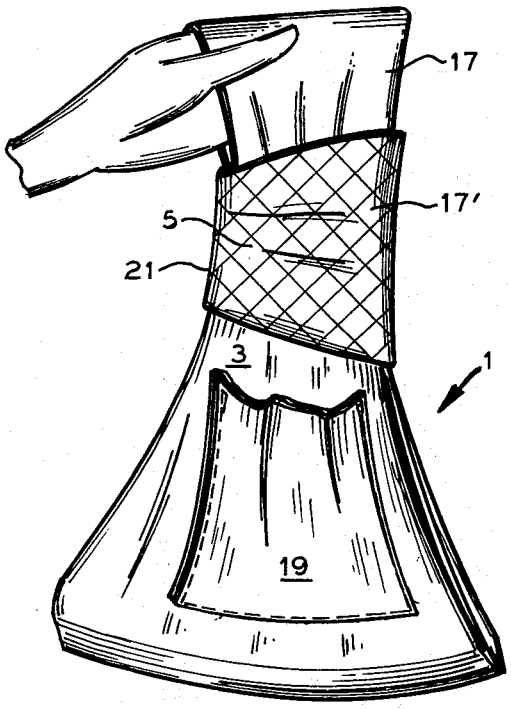
FIG. 5 is a front view of the handbag illustrated in FIGS. 1, 2 and 3 showing one strap folded upon the other strap and then drawn through the other strap to form a knot closure.

In FIG. 5 the flexible container or handbag 1 is illustrated with one strap 17 slipped over the other strap 17' and subsequently showing strap 17 being slipped through strap 17' to form a knot-closure shown as at 21. Thus, the stap-loop 17 is oriented to extend generally away from the container 1 and the strap-loop 17' is partially disposed within and extends through the inside of the strap-loop 17 and is partially disposed without and extends around the outside of the strap 17. As illustrated in FIG. 5, one of the strap-loops 17' (or both the strap-loops 17 and 17' if desired) may be positioned such that the interior fabric surface 5 is exposed, providing the desired contrast with the exterior facing fabric 3, of the handbag 1 and the pocket 19.

The present invention can be constructed from flexible sheet materials having facings of complementary colors and/or textures, in lieu of a composite material. Such containers of flexible sheet material, such as for example vinyl sheeting, would provide the user with additional accessory combinations. Another embodiment of the present invention comprises the use of flexible sheet material having one side or facing with a wet-look vinyl and the other side or facing with a fabric-look.

The flexible container according to the invention therefore is not only more esthetically appealing than conventional previously known containers, but it is also made more functional by the structural features especially in the cutout areas which form the openings for the container by eliminating bulk in the strap-loop area.

It will be apparent that various modifications of the above described structures may be made without departing from the scope of the present invention.

What is claimed is:

1. A flexible container fabricated of a flexible sheet material, said container having equal side walls, said side walls having an upper portion and a lower portion, said upper portion having a central cutout opening and opposed edge cutout openings defining two carrying and closing loops, said lower portion being joined to form the container, each of said loops having a converging portion, a diverging portion and a narrowest point below the midline of the upper portion where said converging portion changes to said diverging portion and a closure defined by said loops formed by passing one of said loops through the other of said loops whereby such container is loosely closed and may be carried by said one of said loops.

2. The flexible container as claimed in claim 1, wherein the flexible sheet material comprises a composite of at least two differently colored and/or textured facing fabrics, thereby providing interior and exterior surfaces, to enhance the esthetic characteristics of the container, especially when the interior fabric of either or both loops is exposed by folding, to provide contrast with the exterior fabric.

3. The flexible container as claimed in claim 2, wherein the said lower portion comprises a pocket on either or both of said exterior surfaces and wherein said fabrics are reversible by folding said container inside out, to provide greater user capabilities.

4. The flexible container as claimed in claim 1, wherein the said upper portion comprises a folded top edge, and wherein the said central cutout opening and the said opposed edge cutout openings extend downwardly from the folded top edge of the upper portion to substantially the said lower portion.

5. The flexible container as claimed in claim 4, wherein the said loops, at the folded top edge, are of a width slightly less than ½ the width of the container, and said loops between the top edge and the lower portion decrease in width to about ¼ the width of the container, and said loops at their juncture with the lower portion, expand to slightly less than ½ the width of the container.

6. The flexible container as claimed in claim 4, wherein the said central cutout opening is diamond-shaped and the said opposed edge cutout openings are inwardly extending half-diamond shaped, whereby geometric symmetry of the sides of the openings is provided.

7. The flexible container as claimed in claim 1 wherein the flexible sheet material has a glossy facing and a complementary fabric facing.

8. The flexible container as claimed in claim 1, wherein the flexible sheet material comprises a composite material having at least two differently colored/textured facing fabrics.

9. A flexible container and closure comprising a single piece of composite material having at least two differently colored/textured facing fabrics, said composite material having outwardly extending cutout areas along both sides of its longitudinal axis and having lateral inwardly extending cutout areas above and below its transverse midline, said composite material folded along said transverse midline to form two equal sidewalls, said side walls being joined along its edges but not along the sides of the central outwardly extending cutout areas or sides of the lateral inwardly extending cutout areas, to form said container having a central opening and two opposed lateral openings defining two strap-loops, each of said strap-loops having a converging portion and a diverging portion and a narrowest point where said converging portion changes to said diverging portion in the quadrant nearest said joined sidewalls, and a closure defined by said strap-loops formed by passing one of said strap-loops through the other of said strap-loops whereby such container is loosely closed and said one of said strap-loops may be engaged by a user.

10. The flexible container as claimed in claim 9, wherein said strap-loops are of sufficient width to ensure substantially complete closure of the container and wherein at least one of said strap-loops is turned inside out to provide contrasting color and/or texture.

11. The flexible container as claimed in claim 9, wherein the said outwardly extending cutout areas along the said central longitudinal axis and the said lateral inwardly extending cutout areas extend substantially one-quarter the length of said composite material whereby when the said composite material is folded upon said transverse midline, the said cutout areas extend substantially one-half the length of said container.

12. The flexible container as claimed in claim 11 wherein the said outwardly extending cutout areas along the central longitudinal axis has opposed edges of the same configuration and dimension as the said lateral inwardly extending cutout areas, thereby provided geometric symmetry to the sides the openings.

13. The flexible container as claimed in claim 9 wherein the said container has an external pocket.

14. A container fabricated of a flexible sheet material, said container having equal side walls, said side walls having a lower and an upper portion, said lower portion being joined along a portion of its edges to form such container, said upper portion having a central cutout opening and opposed edge cutout openings defining two carrying and closing loops, each of said loops having a converging portion, a diverging portion and a narrowest point below the midline of the upper portion where said converging portion and said diverging portion meet, and a closure defined by said loops and including one of said loops oriented to extend away from said lower portion and the other of said loops disposed around and having a portion oriented substantially normal to said one of said loops whereby such container is loosely closed and said one of said loops may be engaged by a user.

15. A flexible container fabricated of a flexible sheet material, said container having equal side walls, said side walls having an upper portion and a lower portion, said upper portion having a central cutout opening and opposed edge cutout openings defining two carrying and closing loops, said lower portion being joined to form the container, each of said loops having a converging portion, a diverging portion and a narrowest point below the midline of the upper portion where said converging portion changes to said diverging portion and a closure defined by said loops formed by passing one of said loops through the other of said loops and subsequently passing said other of said loops through said one of said loops whereby such container may be carried by said other of said loops.

16. A flexible container and closure comprising a single piece of composite material having at least two differently colored/textured facing fabrics, said composite material having outwardly extending cutout areas along both sides of its longitudinal axis and having lateral inwardly extending cutout areas above and below its transverse midline, said composite material folded along said transverse midline to form two equal side walls, said side walls being joined along its edges but not along the sides of the central outwardly extending cutout areas or sides of the lateral inwardly extending cutout areas, to form said container having a central opening and two opposed lateral openings defining two strap-loops, each of said strap-loops having a converging portion and a diverging portion and a narrowest point where said converging portion changes to said diverging portion in the quadrant nearest said joined sidewalls, and a closure defined by said strap-loops formed by passing one of said strap-loops through the other of said strap-loops and subsequently passing said other of said strap-loops through said one of said strap-loops whereby said other of said strap-loops may be engaged by user.

17. A container fabricated of a flexible sheet material, said container having equal side walls, said side walls having a lower and an upper portion, said lower portion being joined along a portion of its edges to form such container, said upper portion having a central cutout opening and opposed edge cutout openings defining two carrying and closing loops, each of said loops having a converging portion, a diverging portion and a narrowest point below the midline of the upper portion where said converging portion and said diverging portion meet, and a closure defined by said loops and including one of said loops oriented to extend substantially away from said lower portion and the other of said loops is partially disposed within and extends through the inside of said one of said loops and is partially disposed without and extends around the outside of said one of said loops whereby such container is securely closed and said one of said loops may be engaged by a user.

* * * * *